US005145284A

United States Patent [19]

Hulett et al.

[11] Patent Number: 5,145,284

[45] Date of Patent: Sep. 8, 1992

[54] METHOD FOR INCREASING THE END-BEARING CAPACITY OF OPEN-ENDED PILES

[75] Inventors: Jeffrey M. Hulett, Surrey, England; James D. Murff; Richard D. Raines, both of Houston, Tex.

[73] Assignee: Exxon Production Research Company, Houston, Tex.

[21] Appl. No.: 484,039

[22] Filed: Feb. 23, 1990

[51] Int. Cl.[5] ..... E02D 5/22; E02D 5/66

[52] U.S. Cl. ..... 405/232; 405/227; 405/231; 405/249

[58] Field of Search ..... 405/222, 223, 227, 228, 405/231, 232, 244, 249, 242, 243, 253, 235, 236, 248

[56] References Cited

U.S. PATENT DOCUMENTS

| | | | |
|---|---|---|---|
| 2,080,493 | 5/1937 | Marsden | 405/253 X |
| 2,779,161 | 1/1957 | Pickman . | |
| 3,022,634 | 2/1962 | Kinneman et al. . | |
| 3,932,999 | 1/1976 | Todd | 405/249 |
| 3,960,008 | 6/1976 | Goble et al. | 73/84 |
| 4,575,282 | 3/1986 | Pardue et al. | 405/228 |
| 4,902,171 | 2/1990 | Geffraud et al. | 405/232 |

FOREIGN PATENT DOCUMENTS

| | | | |
|---|---|---|---|
| 837375 | 3/1952 | Fed. Rep. of Germany | 405/231 |
| 516382 | 2/1955 | Italy | 405/232 |
| 150825 | 8/1984 | Japan | 405/231 |
| 92512 | 5/1985 | Japan | 405/231 |
| 230427 | 11/1985 | Japan | 405/244 |
| 1506027 | 9/1989 | U.S.S.R. | 405/231 |

OTHER PUBLICATIONS

Daniel L. Borin, "Auger Injected Concrete Piles", Jun. 1980, p. 55, Consulting Engineer, vol. 44, No. 6.

Neely et al., "Pressure Injected Footings in Piedmont Profiles", pp.40 & 41, Engineering Societies Library.

McAnally and Douglas, "The Design of Frankipiles in Clays", p. 402, Fourth Australia—New Zealand Conference on Geomechanics, Perth, 14–18, May 1984.

Randolph, M. F., "Capacity of Piles Driven into Dense Sand", Cambridge University Engineering Department, Jun. 1985.

*Primary Examiner*—Dennis L. Taylor
*Assistant Examiner*—John A. Ricci
*Attorney, Agent, or Firm*—Kelly A. Morgan; Keith A. Bell

[57] ABSTRACT

A method for increasing the end-bearing capacity of an open-ended pile is disclosed. The method comprises first determining the quantity of granular material necessary to insure full mobilization of the available capacity of the soil at the tip of the pile. The granular material is then inserted within the pile on top of the soil column, thereby causing the column of granular material to plug or lock-up within the pile during transient loading and thus mobilize the available capacity.

6 Claims, 1 Drawing Sheet

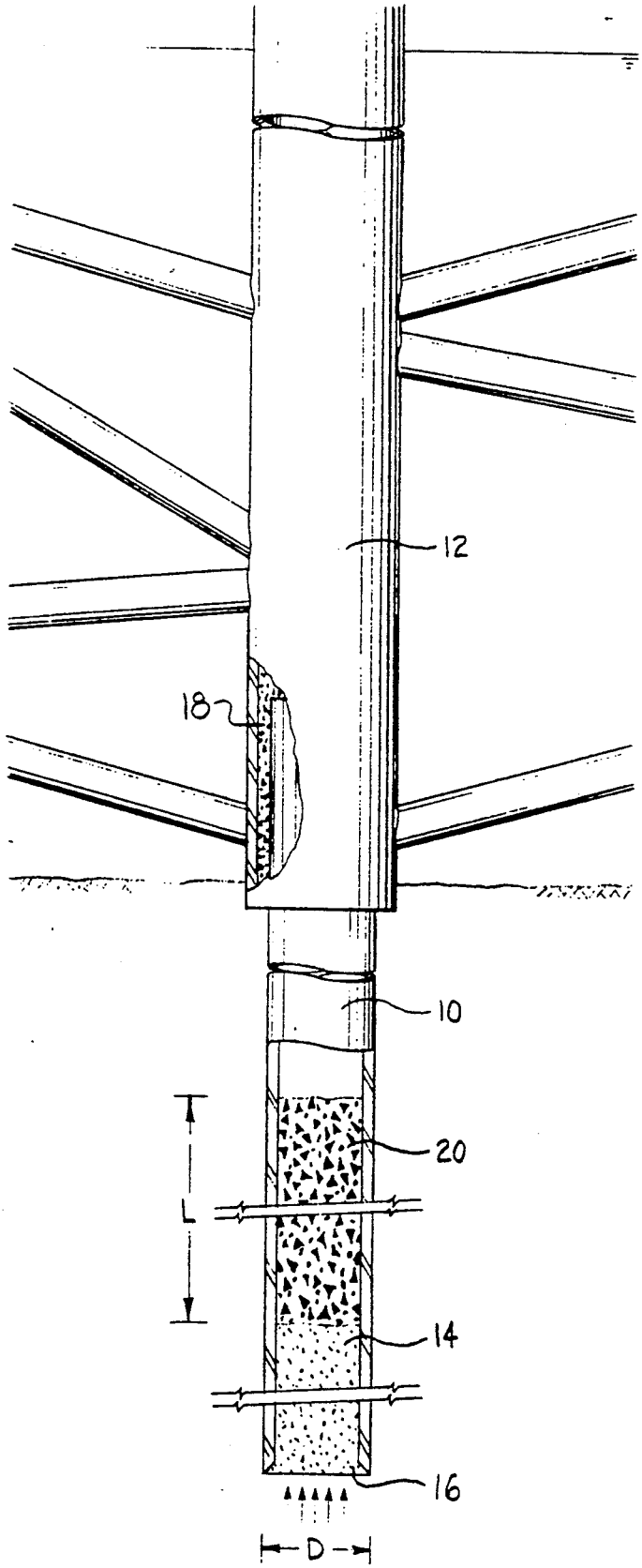
12
18
10
20
L
14
16
D

METHOD FOR INCREASING THE END-BEARING CAPACITY OF OPEN-ENDED PILES

FIELD OF THE INVENTION

This invention relates generally to the field of foundation piles for providing a load-bearing foundation for a structure and, in particular, for an offshore platform structure. More specifically, but not by way of limitation, the invention pertains to a method for increasing the end-bearing capacity of open-ended piles.

BACKGROUND OF THE INVENTION

Many offshore platforms are constructed as tower-like structures consisting of a welded steel space frame or "jacket" founded on or in the sea bottom and extending upwardly to an above-water deck which carries the desired drilling, producing, processing, and living facilities. These structures require strong foundations which can resist varying combinations of static and environmental loads. At most sites, pile foundations serve this purpose. Typically, after the platform jacket is positioned on the sea bottom, a pile, consisting of a hollow steel tube usually open at its bottom, is inserted through each jacket leg. Piles are normally installed by large pile hammers which are used to drive the individual piles to the desired penetration. Alternatively, it may be possible to install an open-ended pile by other means such as pushing or vibration. After the piles have been installed to the desired penetration, they are welded or grouted to the jacket.

Foundation piles must be designed to transfer all loads from the deck and jacket of the offshore structure to the underlying soil. These loads consist of tension or compression loads along the pile axis and lateral loads acting perpendicular to the pile axis. The pile penetration required to resist these loads is a function of the pile shaft friction capacity and the end-bearing capacity. The capacity of the pile foundation, including both pile shaft friction capacity and end-bearing capacity, should be such that the dead load (in water weight) of the complete offshore structure and its facilities can be carried by the pile foundation. Further, during earthquake loading or storm wave loading, the piles should carry the additional loads and there should be no reduction in the capacity of the piles, thereby insuring the safety of the structure.

As is well known to those skilled in the art, the maximum available end-bearing capacity (hereinafter referred to as "available capacity") for supporting a pile depends on the type of soil below the pile tip. For example, when a pile tip is driven into clay, the available capacity typically ranges from about 20,000 to about 30,000 pounds per square foot ("psf"). However, when a pile tip is driven into dense sand, the available capacity ranges from about 200,000 to about 300,000 psf. The actual end-bearing capacity of a pile will depend on the extent to which the available capacity is mobilized. If the available capacity is fully mobilized, then the actual end-bearing capacity of an open-ended pile will be substantially equivalent to that of a closed-end pile having the same diameter.

When an open-ended pile is driven into the sea bottom, a soil column will form within the pile and the available capacity of the particular soil strata at the pile tip may be partially or fully mobilized by plugging of the soil column within the pile. As suggested by Randolph (Randolph, M. F., "Capacity of Piles Driven into Dense Sand", presentation to the XI International Conference of Soil Mechanics and Foundation Engineering, San Francisco, 1985), for fully drained conditions it is likely that the available capacity will be fully mobilized when an open-ended pile is loaded if the soil column within the pile locks-up. As used herein, "fully drained" conditions exist when the pore water pressure within the soil column which is developed upon loading of the pile does not significantly increase above ambient pressure (i.e. hydrostatic pressure), or alternatively, dissipates quickly thereafter.

During loading, the existing soil column within an open-ended pile will plug, or "lock-up", when the inside skin friction at the pile wall becomes equal to the end-bearing capacity of the cross-sectional area of the pile. The basic mechanism for this "lock-up" effect is as follows: As the open-ended pile is loaded, shear load is transferred into the existing soil column and eventually to the bearing stratum at the pile tip. This shear load manifests itself as an increased vertical stress in the soil column. It is well known that vertical stress in a soil column will create an increased lateral stress on the column wall, or in this instance the pile wall. This lateral stress increases the inside skin friction, or shear capacity, at the pile wall due to simple Coulomb friction which in turn again increases the vertical stress in the soil column. This behavior propagates up the soil column and, in this manner, the inside skin friction at the pile wall increases at an exponential rate causing the soil column to plug or "lock-up". Thus, a locked-up pile will bear substantially the same load as a closed-end pile having the same diameter.

During non-static (transient) loading, such as earthquake or storm wave loading, the existing soil column within the pile may only "partially drain" and, accordingly, may not effectively plug, or lock-up, within the pile. Thus, the available capacity may not be fully mobilized. Partially drained conditions occur when the pore water pressure within the soil column which is developed upon loading increases significantly above ambient conditions and does not dissipate quickly thereafter.

Wave and earthquake loading are typically applied to the pile foundation in a matter of a few seconds or less. Because of this short loading period, the soil column may only partially drain and the increased vertical stress in the soil column caused by the shear load, will be carried largely or totally by the water within the pores of the soil column. As a result, the soil column tends to develop low vertical intergranular stress and thus low lateral stress on the pile wall, and the inside skin friction at the pile wall may not increase enough to fully mobilize the end-bearing capacity of the pile: The existing soil column within the pile may slip, rather than plug within the pile.

Under transient conditions such as those described above, the actual plugging behavior of the soil column is difficult to determine and typically requires sophisticated modeling approaches such as finite element analysis. Soil column plugging behavior is influenced by (a) the installation method, (b) the amount of platform gravity load carried by the soil column at the beginning of design loading, (c) the degree of arching in the soil column, (d) the stress-strain behavior of the soil column upon loading, and (e) the rate of loading of the soil column. All of these are difficult to determine, and the effects of each are not well known. In addition to the foregoing, soil column plugging behavior is also influenced by the permeability of the soil column. Very permeable soils will develop lower pore water pressures over a larger region of the soil column and are more prone to plug or lock-up. The tendency of a soil to develop low pore water pressure is also difficult to determine.

For the foregoing reasons, behavior of an existing soil column in a pile under partially drained or transient conditions is difficult to predict, and therefore the ability of the existing soil column within the pile to plug, or lock-up, and thereby fully mobilize the available capacity of the soil is also difficult to predict. As a result, open-ended piles may need their end-bearing capacity increased to insure that the pile foundation can support the complete offshore structure and its facilities, even during wave and earthquake loading. One conventional method used to insure that a pile is fully plugged is to drill out the soil column and set a grout plug. Another method is to place a grout plug on top of the soil column. Both of these methods are time consuming and particularly expensive offshore. The present invention is aimed at providing a practical and economical method for increasing the end-bearing capacity of open-ended piles.

SUMMARY OF THE INVENTION

The present invention is a method for increasing the end-bearing capacity of open-ended piles. The method consists of first determining the quantity of a granular material necessary to insure complete plugging of the pile and thus insure full mobilization of the available capacity of the soil located at the pile tip. Second, this quantity of granular material is inserted into each pile on top of the existing soil column within the pile. The grain size of the granular material is selected so that the column of granular material will have a high permeability and the pore water pressure will therefore not increase significantly above ambient pressure during transient loading. Accordingly, the increased vertical stress in the granular column caused by the transient loading will be carried by the granular material and not the pore water. As previously described, the granular material will lock-up within the pile and thereby increase the end-bearing capacity of the pile.

BRIEF DESCRIPTION OF THE DRAWINGS

The advantages of the present invention will be better understood by referring to the following detailed description and the attached FIGURE which illustrates an open-ended pipe pile with a quantity of gravel on top of the soil column within the pile.

While the invention will be described in connection with its preferred embodiments, it will be understood that the invention is not limited thereto. On the contrary, it is intended to cover all alternatives, modifications, and equivalents which may be included within the spirit and scope of the invention, as defined in the appended claims.

DETAILED DESCRIPTION OF THE PREFERRED EMBODIMENT

The present invention will be described and illustrated herein as a pile foundation for an offshore platform structure; however, the invention may be used in connection with foundations for other types of structures, both on land and offshore. To the extend that the following detailed description is specific to a particular embodiment or a particular use of the invention, this is intended to be by way of illustration and not by way of limitation.

When an offshore platform structure is installed, open-ended piles are typically used as foundations for the structure. These piles, as previously discussed, are usually driven into the ocean floor to design penetration. The available capacity of the soil located at the pile tip can be determined using methods and calculations well known to those skilled in the art. Under fully drained conditions, the available capacity may be fully mobilized by plugging of the existing soil column within the pile. However, under transient loading conditions, such as wave or earthquake loading, the existing soil may be only partially drained and therefore may not fully mobilize the available capacity. Accordingly, the end-bearing capacity of each pile may need to be increased.

Applicants' invention provides a practical and economical method for insuring full mobilization of the available capacity. This method is particularly useful for open-ended piles with their tips in dense sand. Although the method would be effective with piles having their tips in clay, the available capacity of clay is usually fully mobilized as a results of the plugging of the clay within the pile.

Referring now to the FIGURE, an open-ended pile 10 attached by grout 18 to leg 12 of an offshore platform is illustrated. When pile 10 is installed, soil column 14 will enter into open end 16 of pile 10. After pile 10 has been driven to design penetration, a quantity of granular material 20 is inserted, using a hopper or other apparatus well known to those skilled in the art, into each pile 10 on top of existing soil column 14. As more fully explained below, the end-bearing capacity of pile 10 is thereby increased.

Under static loading, it is likely that soil column 14 within pile 10 will be fully drained and will fully mobilize the available capacity of the soil. However, under transient loading, the increased vertical stress in soil column 14 caused by the shear load will be carried largely or totally by the water within the pores of the soil. The soil therefore tends to develop low vertical intergranular stress and the lateral stress developed at the pile wall, as described by Randolph, may be low. Therefore, soil column 14 may not lock-up and fully mobilize the available capacity.

With Applicants' inventive method, upon transient loading of the platform, granular material 20 will be "fully drained" in that the pore water pressure will not increase significantly above ambient conditions. As a result, the vertical stress caused by the load will be carried by granular material 20, rather than the pore water, and will manifest itself as an increased lateral stress on the pile wall, similarly to a fully drained soil column under static load. This lateral stress will increase the inside skin friction at the pile wall, which in turn increases again the vertical stress in granular material 20. The inside skin friction increases at an exponential rate until granular material 20 locks-up within the pile 10. This results in full mobilization of the available capacity of the soil.

In order to determine to quantity of granular material 20 necessary to fully develop the available capacity of a pile 10 driven into dense sand, theoretical studies as well as laboratory and field tests were performed. The theoretical studies indicated that, in general, a column of granular material 20 having a length "L" of from 5–10 times the outer diameter "D" of the pile 10 should be sufficient. However, given the inherent uncertainty of these theoretical studies, the laboratory and field tests were conducted to verify the results.

In the laboratory tests, the following parameters were varied:

type of granular material 20 (various sand and small gravels were tested);

density of granular material 20 (loose to dense);

rate of loading (slow to as fast as possible);

plug length L.

Sand and gravel placement was carried out in both wet and dry environments. For the dry samples, the sand was placed primarily by raining through a tube fitted with a sieve. The sieve enhanced the placement technique causing the sand to pack in a denser and more homogenous manner. In the wet environment, the sand was fluviated through a column of water and was allowed to seek equilibrium independent of any external influences. The results from these tests indicated that the "lock-up" behavior did occur. For example, pressures up to 1,000,000 psf were supported by sand columns about 1.6 feet long or about 6.5 times the diameter of the model pile. Further, the load applied was fully carried by shear transfer from the granular material to the pile walls as no cap or other obstruction was placed on top of the sand or gravel.

The same parameters used in the laboratory experiments were varied in the field tests. The sand or gravel was placed by dumping from a bucket. In certain cases the sand or gravel was artificially compacted by small vibration or displacement cycling. For these tests, the results indicated that the length L of the column of granular material 20 which would plug and fully mobilize an available capacity of 200,000 to 300,000 psf was, conservatively, about 8 times the outside diameter D of pile 10.

The type of granular material 20 recommended for use should be free draining so that excess pore pressure will not form upon loading. Granite of approximately one to two inches in diameter was found to be most effective. Further, granular material 20 should be relatively non-friable and placed in as dense a state as possible. The field experiments indicated that the in-place density of granular material 20 prior to loading was an important factor in insuring lock-up. If pile 10 and granular material 20 are easily accessible, means should be taken to artificially compact granular material 20 so that it is as dense as possible. In an offshore environment where accessibility is an issue, sub-yield wave loading will contribute to the densification of the column of granular material 20.

As described and illustrated herein, the present invention satisfies the need for a practical system and method for increasing the end-bearing capacity of open-ended piles. It should be understood that the invention is not to be unduly limited to the foregoing which has been set forth for illustrative purposes. Various alternations and modifications of the invention will be apparent to those skilled in the art without departing from the true scope of the invention, as defined in the following claims.

What we claim is:

1. A method for insuring full mobilization of the end-bearing capacity of an open-ended pile, said pile being substantially vertical and being driven into the earth such that a soil column is formed in the lower end of said pile, said method comprising the steps of:

(a) determining the quantity of a loose, unagglutinated, granular material which will lock-up, without cementation, within said pile during loading of said pile and thereby insure full mobilization of the available capacity of the soil at the tip of said pile; and (b) inserting at least said quantity of said granular material into said pile on top of said soil column.

2. The method of claim 1 wherein said pile tip is located in dense sand.

3. The method of claim 1 wherein said granular material is granite.

4. The method of claim 1 wherein said granular material is approximately one to two inches in diameter.

5. The method of claim 1 whereby said granular material is non-friable.

6. The method of claim 1 wherein the quantity of granular material is determined such that the length of the column of granular material is from about 5 to about 10 times the outside diameter of said pile.

* * * * *